US007033065B2

(12) United States Patent
Leung et al.

(10) Patent No.: US 7,033,065 B2
(45) Date of Patent: Apr. 25, 2006

(54) LAMP RETAINER ASSEMBLY

(75) Inventors: Benson Chung-Pun Leung, Kwai Chung (HK); Ambrose Shing-Yin Leung, Kwai Chung (HK)

(73) Assignee: The Coleman Company, Inc., Wichita, KS (US)

( * ) Notice: Subject to any disclaimer, the term of this patent is extended or adjusted under 35 U.S.C. 154(b) by 86 days.

(21) Appl. No.: 10/860,437

(22) Filed: Jun. 3, 2004

(65) Prior Publication Data

US 2005/0030742 A1 Feb. 10, 2005

Related U.S. Application Data

(60) Provisional application No. 60/492,861, filed on Aug. 6, 2003.

(51) Int. Cl.
*H01R 33/97* (2006.01)

(52) U.S. Cl. ..... 362/655; 362/640; 439/233; 439/347

(58) Field of Classification Search ..... 362/226, 362/640, 647, 652, 655, 656
See application file for complete search history.

(56) References Cited

U.S. PATENT DOCUMENTS

| | | | | |
|---|---|---|---|---|
| 4,713,019 | A | 12/1987 | Gaynor | |
| 5,320,547 | A | 6/1994 | Mews et al. | |
| 5,795,192 | A * | 8/1998 | Ullrich | 439/619 |
| 5,860,730 | A | 1/1999 | Hesprich | |
| 6,340,310 | B1 | 1/2002 | Henrici et al. | |

OTHER PUBLICATIONS

OSRAM, "Compact Fluorescent Lamps", Product Catalog, 49pgs (2002).

* cited by examiner

*Primary Examiner*—Renee Luebke
*Assistant Examiner*—Leah Lovell
(74) *Attorney, Agent, or Firm*—Leydig Voit & Mayers, Ltd.

(57) ABSTRACT

A retainer for securing a lamp having a connector. The retainer includes a pedestal having a circumference. A socket for receiving the connector is defined by the pedestal and includes a perimeter extending beyond the socket. A retainer is operably connected to the pedestal and is linearly confined between a first position and a second position. The retainer traverses the perimeter of the socket in its first position. An inhibitor capable of being secured about the circumference of the pedestal constrains the first member in its first position to impede removal of the lamp.

19 Claims, 6 Drawing Sheets

LAMP RETAINER ASSEMBLY

REFERENCE TO RELATED APPLICATION

This application claims the benefit of U.S. Provisional Application No. 60/492,861, filed Aug. 6, 2003, and incorporated herein by reference.

TECHNICAL FIELD OF THE INVENTION

The present invention generally relates to a lamps, and more particularly to a lamp retainer assembly.

BACKGROUND OF THE INVENTION

Single-end—single connector—fluorescent lamps have become popular due to their compact size, high power efficiency, and extended operational life. These fluorescent lamps, e.g., bulbs, provide the same brightness at up to 80% reduction in power consumption and up to 15 times the operational life of regular incandescent bulbs of similar size.

The compactness of the singled-end connector design of today's fluorescent lamps contributes to the lamp's increasing utilization in household lighting fixtures and portable lighting devices, e.g., ceiling lights, table lamp assemblies, and electric lanterns, etc. A contrast to the conventional dual-end—dual connector—straight fluorescent lamp, the compact single-end design has contributed to the rising popularity of the single-connector fluorescent lamp.

Currently, a conventional lamp retainer of a single-end pin-based lamp generally retains the lamp by having at least one clasp-like member—typically a small, pivotable, pliable piece of plastic or metal integral with a lamp connector socket—grip the single-end connector of the lamp by protrusion over, or into, the lamp connector.

Although these current lamp retainer designs provide a convenient means of insertion, retention, and removal of a lamp having a single-end pin-based connector, the small flexible clasp utilized in current lamp retainers can be easily moved by minor, unintentional movements of larger and heavier lamps—thus making the lamp prone to unintentional dislocation from the lamp retainer. The unintentional dislocation of the lamp often causes the lamp to prematurely malfunction, or break, long before its intended operational life expectancy.

When a current lamp retainer is implemented with a portable illuminating device, e.g., lantern, table lamp assembly, etc., the retainer is often not able to secure the lamp against removal due to severe movement. Although a more robust design incorporating a shock absorbing plug and an elongate light-transmitting protective shield surrounding the lamp are available, such a design lacks applicability for lamps having a different length, e.g., a lamp having a standard connector size, but with a higher power and brightness, and correspondingly, requiring a longer protective shield.

The present invention is provided to solve these and other problems and to improve upon existing portable lamps and lamp retainers.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An embodiment is directed to a retainer for a lamp being utilized in potentially severe situations, e.g., susceptible to being abruptly jarred or dropped. More specifically, one embodiment involves a retainer for a lamp having a connector. The retainer comprises a pedestal including a circumference. The circumference extends vertically beyond the physical dimensions of the pedestal. A socket for receiving the lamp connector is defined within the pedestal and includes a perimeter. The perimeter vertically extends beyond the physical dimensions of the socket. A first member is operably connected to the pedestal and includes a first position and a second position. The first member traverses the perimeter of the socket in the first position, and traverses the circumference of the pedestal in the second position. An inhibitor removably attached to the pedestal is capable of constraining the first member in the first position.

A further embodiment includes the first member being biased toward the first position.

Yet another embodiment includes a plurality of members being operably connected to the pedestal.

A still further embodiment includes a control switch being operably connected to the socket. The control switch includes a first state (ON) and a second state (OFF).

The lamp retainer facilitates convenient insertion and removal of a lamp and including a robust means of securing the lamp under severe conditions.

Other features of the invention will become apparent from the following detailed description when taken in conjunction with the drawings, in which:

DETAILED DESCRIPTION

Figure 1:
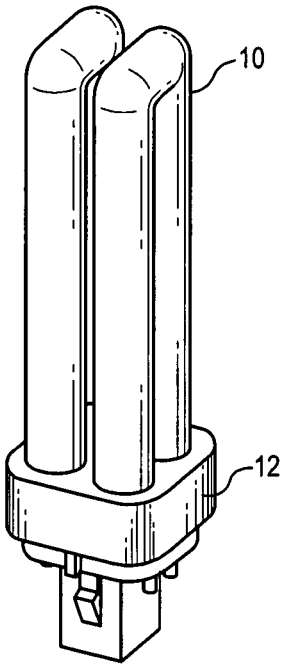
FIG. 1 is a perspective view of one embodiment of a single-end fluorescent lamp.
Figure 2:
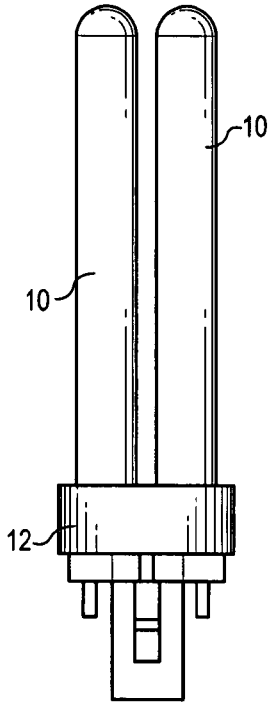
FIG. 2 is a front view of the single-end fluorescent lamp shown in FIG. 1.
Figure 3:
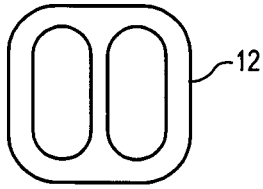
FIG. 3 is a top view of the single-end fluorescent lamp shown in FIG. 1.
Figure 4:
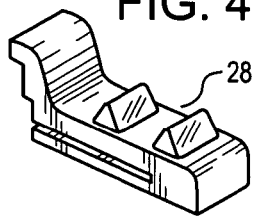
FIG. 4 is a perspective view of a first member in accordance with one embodiment of the present invention.
Figure 5:
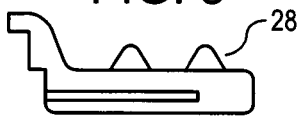
FIG. 5 is a front view of the first member shown in FIG. 4.

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Referring now to the drawings, in which like reference numerals represent like parts throughout the several views, the present invention is directed to fluorescent lamps. More specifically, the present invention is directed to providing a mechanism for securing a portable lamp frequently exposed to severe conditions, abuse, or abrupt movements—intentional or unintentional.

Figure 17:
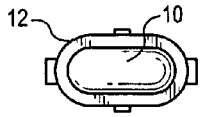
FIG. 17 is a top view of the single-end pin-based fluorescent lamp shown in FIG. 15.
Figure 15:
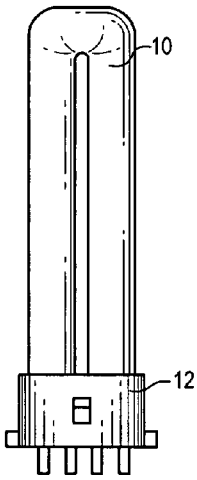
FIG. 15 is a perspective view of another embodiment of a single-end pin-based fluorescent lamp.
Figure 16:
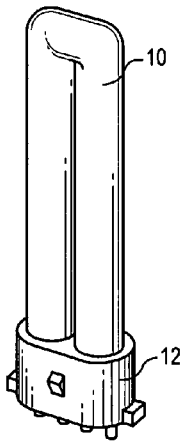
FIG. 16 is a front view of the single-end pin-based fluorescent lamp shown in FIG. 15.
Figure 18:
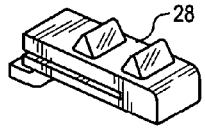
FIG. 18 is a perspective view of an alternate embodiment of a first member.
Figure 19:
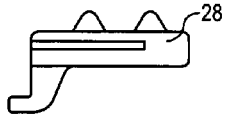
FIG. 19 is a front view of the embodiment of the first member shown in FIG. 18.
Figure 20:
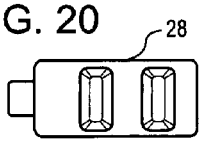
FIG. 20 is a top view of the first member shown in FIG. 18.

Two typical fluorescent lamps 10 having a single-end connector 12 are shown in FIGS. 1–3 and 15–17. Pins extending from the pin-based connector 12 shown in FIGS. 15–17 are capable of being operably connected to a circuit (not shown, but known in the art) for operating the lamp 10.

Figure 7:
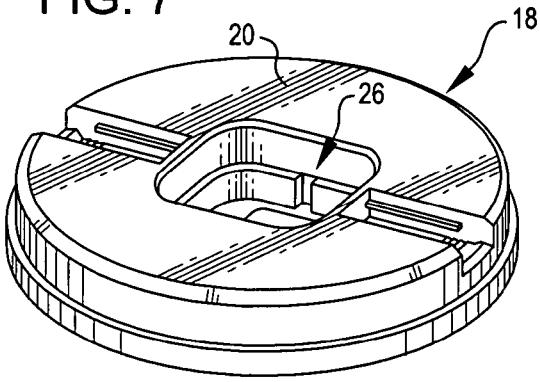
FIG. 7 is a perspective view of a pedestal in accordance with one embodiment of the present invention.
Figure 6:
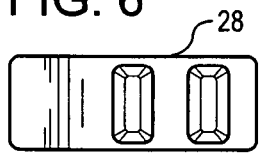
FIG. 6 is a top view of the first member shown in FIG. 4.
Figure 8:
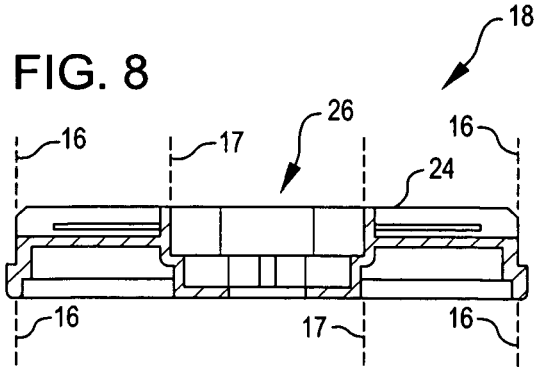
FIG. 8 is a cross-sectional front view of the pedestal shown in FIG. 7.
Figure 9:
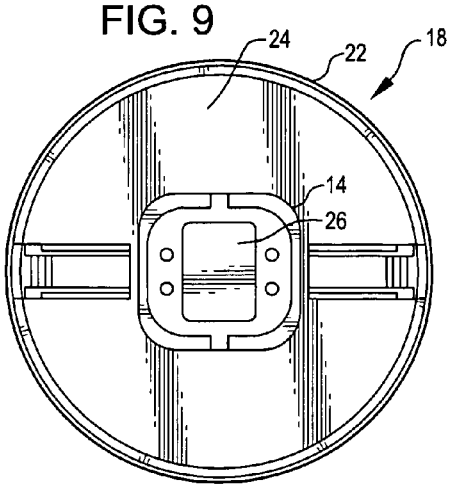
FIG. 9 is a top view of the pedestal shown in FIG. 7.
Figure 21:
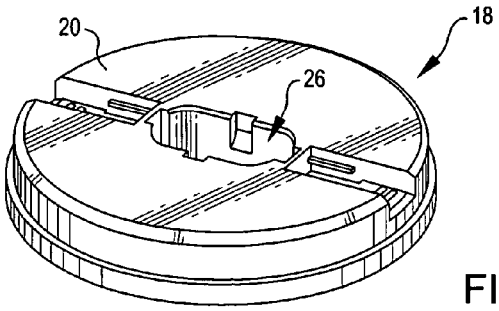
FIG. 21 is a perspective view of a pedestal in accordance with an embodiment.
Figure 22:
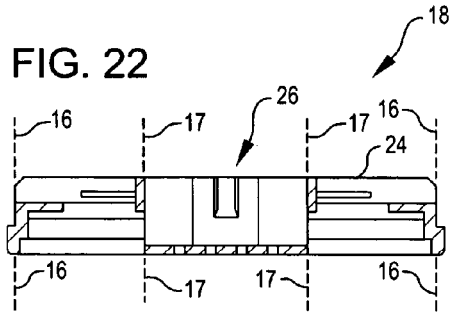
FIG. 22 is a front view of the pedestal shown in FIG. 21.
Figure 23:
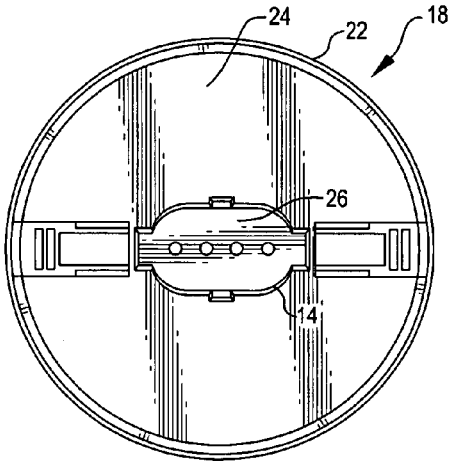
FIG. 23 is a top view of the pedestal shown in FIG. 21.
Figure 24:
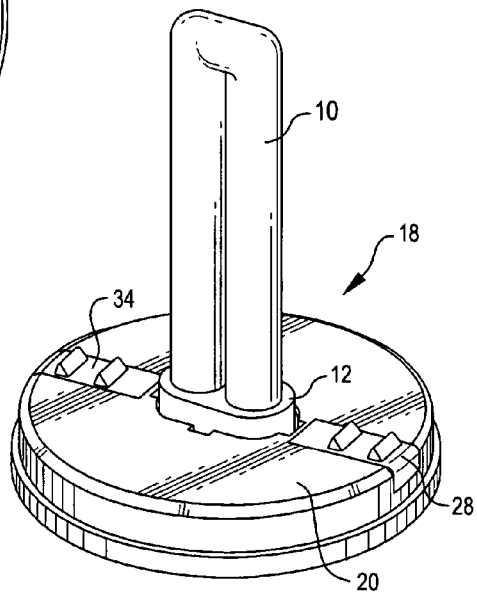
FIG. 24 is a perspective view of perspective view of a combined lamp, pedestal, and first and second members in accordance with an embodiment, the first and second members being shown in a first position.
Figure 25:
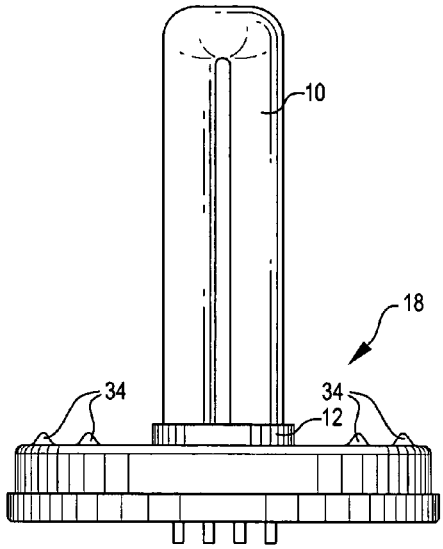
FIG. 25 is a front view of the combined lamp, pedestal, and first and second members shown in FIG. 24.
Figure 26:
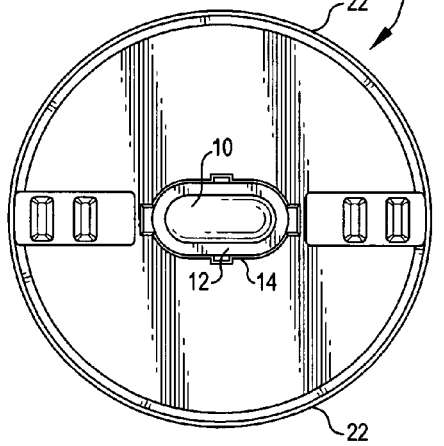
FIG. 26 is a top view of the combined lamp, pedestal, and first and second members shown in FIG. 24.
Figure 27:
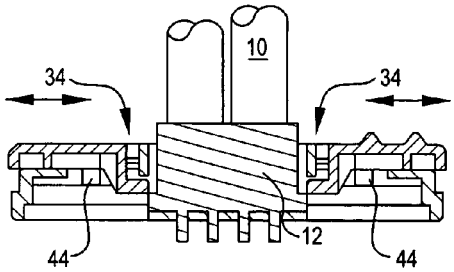
FIG. 27 is a partial cross-sectional view of FIG. 25 with the first and second members in the first position.
Figure 28:
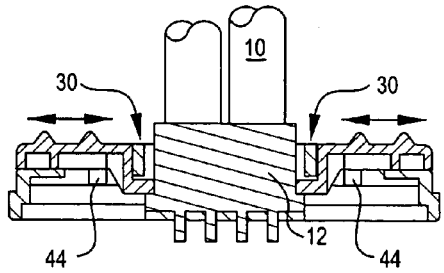
FIG. 28 is a partial cross-sectional view of FIG. 25 with the first and second members in the second position.

A socket 26 for receiving the lamp connector 12 is defined by the pedestal 20 and shown in FIGS. 7 and 21. The socket 26 includes a perimeter 14 (e.g., FIGS. 9 and 23). Similar to the circumference 22 of the pedestal 20, the perimeter 14 extends vertically beyond the physical dimensions of the socket 26, as shown by the dotted lines 17 in FIGS. 8 and 22. The socket 26 may be defined substantially within the pedestal 20, or a portion of the socket may extend above the top plane and be defined by a wall (not shown) extending from the pedestal and perpendicular to the top plane 24. In an embodiment, the socket 26 is of substantially the same shape as the connector 12.

A first member 28, shown in FIGS. 4–6 and 18–20, is operably connected to the pedestal 20 and is positioned adjacent to the circumference 22. The first member 28 has a first position 30 and a second position 32 and is, in an embodiment, confined to linear movement within a plane substantially parallel to the top plane 24 as shown by the arrows in FIGS. 13, 14, 27, and 28. Although linearly confined movement of the first member 28 within a plane is disclosed, it is to be understood that curvilinear movement of the first member within the plane substantially parallel to the top plane 24 is within the scope of the present invention. In addition, the first member may be arranged and configured to rotate from a first position to a second position, or may otherwise be configured to move between the two positions. When the first member 28 is in the first position 30, it traverses the perimeter 14 of the socket 26, and thus overlaps the connector 12 to secure the connector from being moved out of the socket. When the first member 28 is in the second position 32, it traverses the circumference 22 of the pedestal 20. Because the first member 28 cannot simultaneously reside in its first and second position, the first member cannot simultaneously traverse the perimeter 14 of the socket 26 and the circumference 22 of the pedestal 20.

Figure 10:
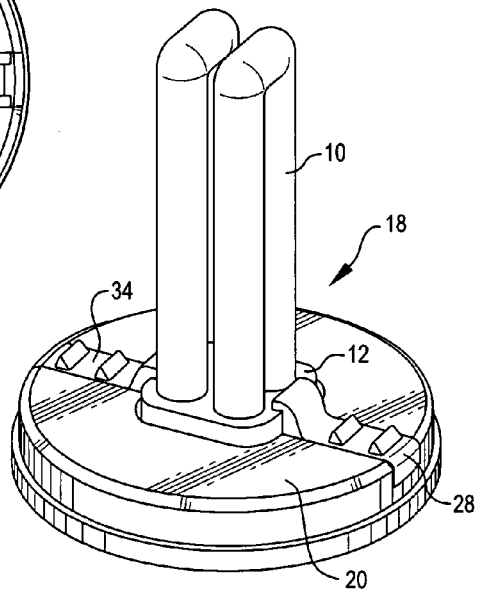
FIG. 10 is a perspective view of a combined lamp, pedestal, and first and second members in accordance with one embodiment, the first and second members being shown in a first position.
Figure 11:
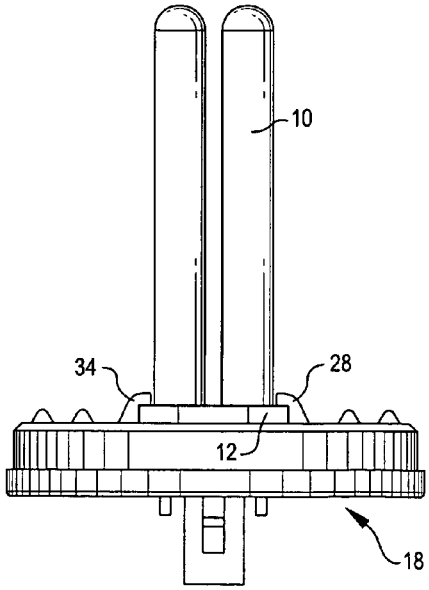
FIG. 11 is a front view of the lamp, pedestal, and members shown in FIG. 10.
Figure 12:
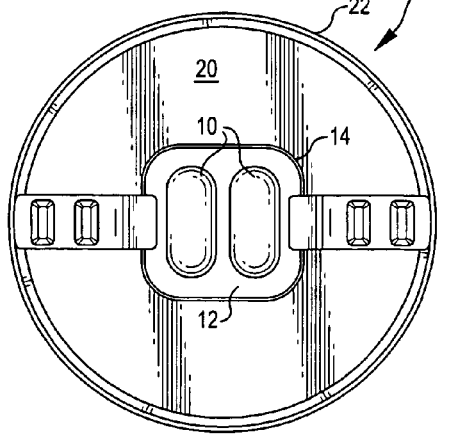
FIG. 12 is a top view of the lamp, pedestal, and members of FIG. 10.
Figure 14:
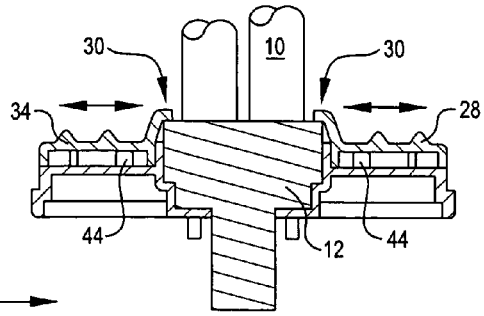
FIG. 14 is a partial cross-sectional view of FIG. 11 with the first and second members in a second position.
Figure 13:
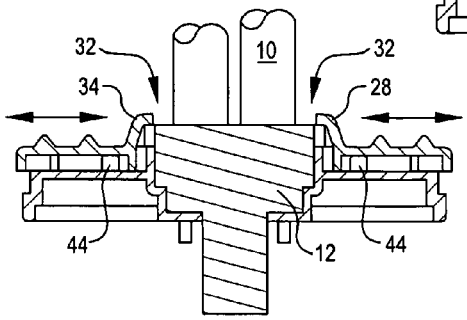
FIG. 13 is a partial cross-sectional view of the lamp, pedestal, and members of FIG. 11, with the first and second members in the first position.

Additional members may be utilized to secure the connector 12 within the socket 26. In accordance with an embodiment shown, for example, in FIG. 10, a second member 34 similar in operation to the first member 28 is positioned opposite the first member 28. In this embodiment, the second member 34 functions similar to the first member 28, and further ensures retaining the connector 12 within the socket 26.

Figure 29:
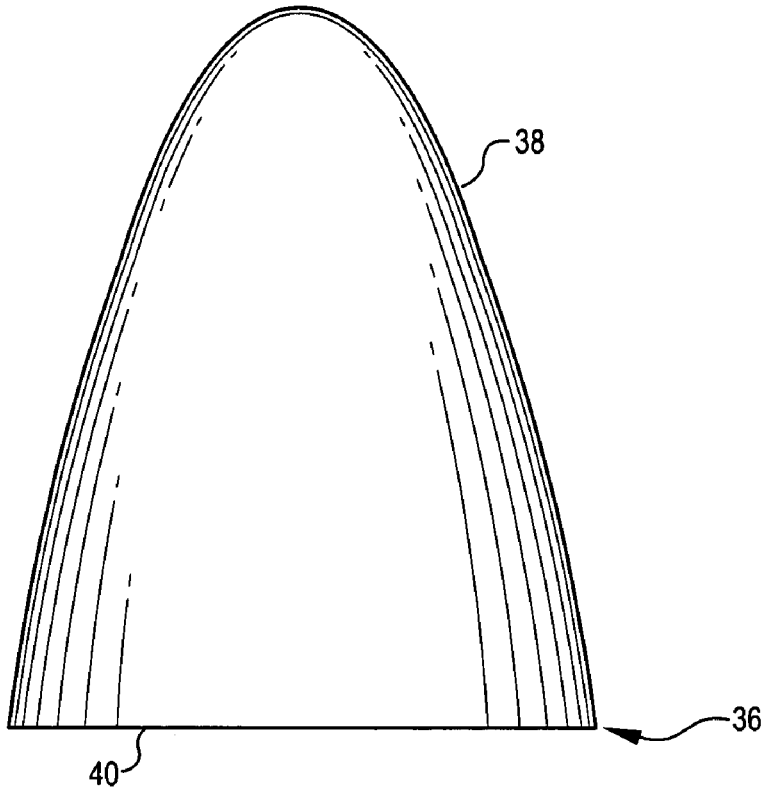
FIG. 29 depicts one embodiment of a lamp shield in accordance with an embodiment of the present invention.

In accordance with an embodiment, an inhibitor 36 (e.g., FIG. 29) capable of being removably affixed, e.g., attached and detached, to the pedestal 20 inhibits movement of the first member 28 into its second position 32 when the inhibitor is attached to the pedestal. In an embodiment, the inhibitor 36 is removably affixed about the circumference 22 of the pedestal 20. The inhibitor 36 may be removably affixed to the pedestal 20 in a variety of ways, e.g., pressure-fit, snapped, screwed, clipped, buckled, etc., and is not limited to the means disclosed within this disclosure. When the inhibitor 36 is attached to the pedestal 20, it constrains the first member 28 in its first position 30. Because the first member 28 is confined to its first position 30, the connector 12 of the lamp 10 cannot be removed from the socket 26 because the first member intersects the perimeter 14 of the socket to impede its removal.

In this embodiment, to remove the lamp 10, the inhibitor 36 is first removed or detached from the pedestal 20. Once the inhibitor 36 is detached, the first member 28 may be moved into its second position 32 wherein the first member no longer crosses the perimeter 14 of the socket 26—nor overlaps the connector 12—and impedes removal of the connector. The removal of the inhibitor 36 allows the first member 28 to traverse the circumference 22 of the pedestal 20 and reach its second position 32. The inhibitor 36 cannot be attached to the pedestal 20 until the first member 28 is moved from its second position 32 into its first position 30. If more than one member is utilized, the operation of the additional member or member may be similar to that of the first member 28.

An additional aspect of the present invention includes biasing the first member 28, and/or members, toward its first position 30. Referring to FIGS. 13, 14, 27, and 28, a bias 44 is operably connected between the pedestal 20 and the first member 28 such that the first member is urged toward its first position 30—i.e., toward the socket 26. The shape of the connector 12 and the first member 28 may be such that quick insertion of the lamp 10 is facilitated by the operable cooperation of the connector and the first member. For example, during insertion of the lamp 10 into the socket 26, the designs of the connector 12 and the first member 28 cooperatively engage wherein a portion of the connector contacts a portion of the first member and urges the first member toward its second position 32, thus allowing the connector to be seated within the socket. Once a portion of the connector 12 slips past the first member 28, the bias 44 urges the first member back to its first position and retains the lamp 10. To remove the lamp 10 from the socket 26, the first member 28 is temporarily placed in its second position 32—opposing the bias 44—to allow the lamp connector 12 to be unseated from the socket 26. After the connector 12 has been removed, the bias 44 acts upon the first member 28 to return it to its first position 28. Any means known to one of ordinary skill in the art may be utilized to bias the first member 28 toward its first position 30, e.g., spring, O-ring, rubber-band, coil, etc.

Figure 30:
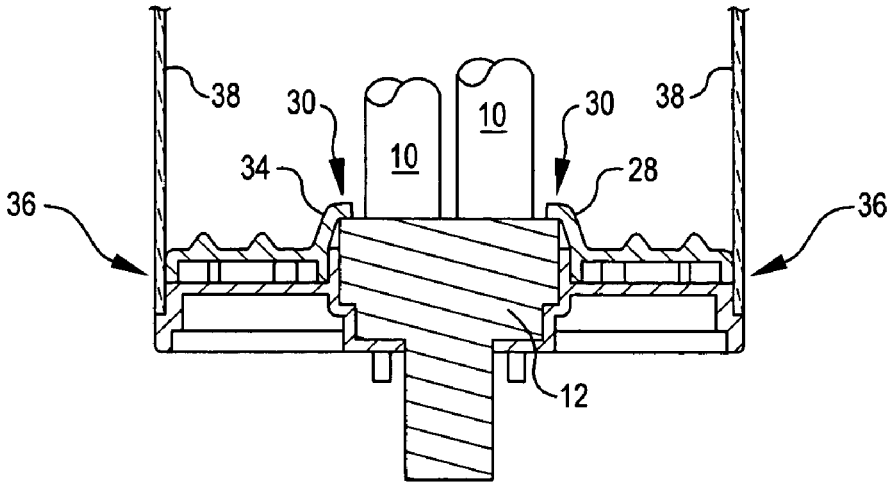
FIG. 30 is a partial cross-sectional view depicting an inhibitor and the lamp shield of FIG. 29 cooperatively affixed to a pedestal.

A lamp shield 38 (e.g., FIG. 29) may be utilized with the retainer 18 to protect the bulb 10 from contacting other objects. In an embodiment, the inhibitor 36 is integral with the lamp shield 38 wherein the inhibitor is positioned to preclude movement of the first member 28 when the lamp shield is attached to the retainer 18. In one embodiment shown in FIG. 29, the lamp shield 38 is a conical lid or cover having a base 40 and a closed end 42. Referring to FIG. 30, the base 40 of the lamp shield 38 is attached to the retainer 18, for example about the circumference 22 of the pedestal 20 wherein the base—functioning as the inhibitor 36—precludes removal of the connector 12 from the socket 26 by impeding movement of the first member 28 out of the first position 30 and thus, the first member continues to traverse the perimeter 14 of the socket 26 and overlap the connector 12 to retain the connector and lamp 10 therein. The lamp shield 38 can be attached to the retainer 18 through a variety of means, e.g., screwed, threaded, clipped, snapped, gripped, etc., or any other means known to one of ordinary skill in the art.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retainer for a lamp having a connector, the retainer comprising:

a pedestal having a circumference, the circumference extending vertically beyond the pedestal;

a socket for receiving the connector, the socket being formed by the pedestal and including a perimeter, the perimeter extending vertically beyond the socket;

a first member being operably connected to the pedestal, the first member configured for movement between a first position and a second position, wherein the first member is positioned to block movement of a connector out of the socket in the first position, and is removed from blocking movement of a connector out of the socket in the second position; and an inhibitor that in a first configuration, constrains the first member in the first position.

2. The retainer of claim 1, wherein the first member traverses the perimeter of the socket in the first position.

3. The retainer of claim 1, further comprising:

a lamp shield, the lamp shield being connected to the inhibitor.

4. The retainer of claim 1, wherein the first member is biased toward the first position.

5. The retainer of claim 1, further comprising:

a second member operatively connected to the pedestal, the second member configured for movement between a first position and a second position, wherein the second member is positioned to block movement of a connector out of the socket in the first position, and is removed from blocking movement of a connector out of the socket in the second position.

6. The retainer of claim 5, wherein the second member traverses the perimeter of the socket in its first position.

7. The retainer of claim 5, wherein the second member is biased toward the first position.

8. A retainer for a lamp having a connector, the retainer comprising:

a pedestal having a circumference, the circumference extending vertically beyond the pedestal;

a socket for receiving the connector, the socket being formed by the pedestal and including a perimeter, the perimeter extending vertically beyond the socket;

a first member being operatively connected to the pedestal, the first member configured for movement between a first position and a second position, wherein the first member is positioned to block movement of a connector out of the socket in the first position, and is removed from blocking movement of a connector out of the socket in the second position; and a second member operatively connected to the pedestal, the second member configured for movement between a first position and a second position, wherein the second member is positioned to block movement of a connector out of the socket in the first position, and is removed from blocking movement of a connector out of the socket in the second position, and wherein the second member is confined to linear movement between its first and second positions.

9. A retainer for a lamp having a connector, the retainer comprising:

a pedestal having a circumference, the circumference extending vertically beyond the pedestal;

a socket for receiving the connector, the socket being formed by the pedestal and including a perimeter, the perimeter extending vertically beyond the socket;

a first member being operatively connected to the pedestal, the first member configured for movement between a first position and a second position, wherein the first member is positioned to block movement of a connector out of the socket in the first position, and is removed from blocking movement of a connector out of the socket in the second position;

a second member operatively connected to the pedestal, the second member configured for movement between a first position and a second position, wherein the second member is positioned to block movement of a connector out of the socket in the first position, and is removed from blocking movement of a connector out of the socket in the second position; and a lamp shield, wherein the lamp shield constrains the first member in the first position and second member in the first position.

10. A retainer for a lamp having a connector, the retainer comprising:

a pedestal having a circumference, the circumference extending vertically beyond the pedestal;

a socket for receiving the lamp connector, the socket being defined within the pedestal and including a perimeter, the perimeter extending vertically beyond the socket;

a first member operably connected to the pedestal and having a first position and a second position, wherein the first member is positioned to block movement of a connector out of the socket in the first position, and is removed from blocking movement of a connector out of the socket in the second position; and an inhibitor to constrain the first member in its first position.

11. The retainer of claim 10, wherein the inhibitor is capable of being secured about the circumference of the pedestal.

12. The retainer of claim 10, wherein the first member is linearly constrained between its first and second positions.

13. The retainer of claim 10, wherein the first member is biased toward its first position.

14. The retainer of claim 10, wherein the first member traverses the perimeter of the socket in the first position.

15. The retainer of claim 10, further comprising:

a second member operably connected to the pedestal, the second member configured for movement between a first position and a second position, wherein the second member is positioned to block movement of a connector out of the socket in the first position, and is removed from blocking movement of a connector out of the socket in the second position.

16. The retainer of claim 15, wherein the inhibitor is capable of constraining the second member in its first position.

17. The retainer of claim 15, wherein the second member is biased toward its first position.

18. The retainer of claim 10, wherein the first member traverses the circumference of the pedestal in its second position.

19. The retainer of claim 10, further comprising: a lamp shield, the lamp shield being connected to the inhibitor.

* * * * *